US007722286B2

(12) United States Patent
Heald

(10) Patent No.: US 7,722,286 B2
(45) Date of Patent: May 25, 2010

(54) DELINEATOR MOUNTING SYSTEM

(76) Inventor: Darrell Heald, 217 Legend Oaks Dr., Georgetown, TX (US) 78628

( * ) Notice: Subject to any disclaimer, the term of this patent is extended or adjusted under 35 U.S.C. 154(b) by 0 days.

(21) Appl. No.: 12/016,985

(22) Filed: Jan. 18, 2008

(65) Prior Publication Data

US 2009/0183452 A1 Jul. 23, 2009

(51) Int. Cl.
*E01F 9/013* (2006.01)

(52) U.S. Cl. ..... 404/9; 40/612; 403/183

(58) Field of Classification Search ..... 40/607.01, 40/607.04, 607.05, 607.1, 612; 404/9; 248/159, 248/188; 403/182, 183, 292, 383
See application file for complete search history.

(56) References Cited

U.S. PATENT DOCUMENTS 3,360,285 A * 12/1967 Huckshold ..... 403/292
4,435,107 A 3/1984 Sweeney
4,557,467 A * 12/1985 Lin ..... 256/59
4,691,818 A * 9/1987 Weber ..... 198/666
4,926,592 A * 5/1990 Nehls ..... 52/98
5,149,149 A * 9/1992 Wu ..... 285/402
5,895,169 A * 4/1999 Holm et al. ..... 404/9
6,516,573 B1 2/2003 Farrell et al.
6,540,196 B1 * 4/2003 Ellsworth ..... 248/548
6,692,180 B2 * 2/2004 Wu ..... 403/292
6,709,234 B2 * 3/2004 Gilbert et al. ..... 415/200
6,868,641 B2 * 3/2005 Conner et al. ..... 52/98

FOREIGN PATENT DOCUMENTS

KR 20-0255623 Y1 12/2001

* cited by examiner

*Primary Examiner*—Gary S Hartmann
(74) *Attorney, Agent, or Firm*—Daniel V. Thompson

(57) ABSTRACT

A delineator mounting system has a coupler for mating a delineator having a cylindrical tubular lower end in a mount having square cross-sections.

2 Claims, 2 Drawing Sheets

DELINEATOR MOUNTING SYSTEM

FIELD OF THE INVENTION

The present invention relates in general to traffic delineators. More specifically, but without restriction to the particular use which is shown and described, this invention relates to cylindrical tubular delineators that may be mounted in square tubing mounts.

BACKGROUND OF THE INVENTION

A traffic delineator is a conventional device used upon many highways to indicate to the driver the edge of the road or, in the alternative, an upcoming division or revision in traffic lanes. In a design of such marking posts or traffic delineators it is desirable for the post to be constructed in a manner which is inexpensive and provides for a quick and simple installation. The post should also be able to withstand many impacts from the bumpers of high speed vehicles without sustaining damage or destroying the post and without pulling the post out of or from connection with the ground/pavement.

The ease and speed of installation is particularly important in view of the large number of parking posts or traffic delineators which are used along the highways and expressways and, in fact, frequently the installation of the posts is performed when the installer is exposed to motor vehicle traffic. For these reasons, it is also desirable for the post to be designed for quick and conventional replacement in the event it is destroyed or no longer usable. Further, the post must be installed in a manner by which the post may not be easily damaged or removed by persons walking along the roadway and/or during the installation process.

Modern traffic delineators are cylindrical in cross-section for ease of manufacture, such as the one disclosed in U.S. Pat. No. 7,179,016. While advanced delineator mounting systems for cylindrical delineators are now available, such as the one disclosed in U.S. Pat. No. 7,003,919, in many localities a relatively primitive, older form of sub-surface mount is required that includes perforated square tubing that is driven into the ground. In such cases it has heretofore not been possible to use cylindrical delineators with driven square tubing mounts due the mismatch in geometry.

SUMMARY OF THE INVENTION

A delineator mounting system has a coupler for mating a delineator having a cylindrical tubular lower end in a mount having square cross-sections.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

Figure 1:
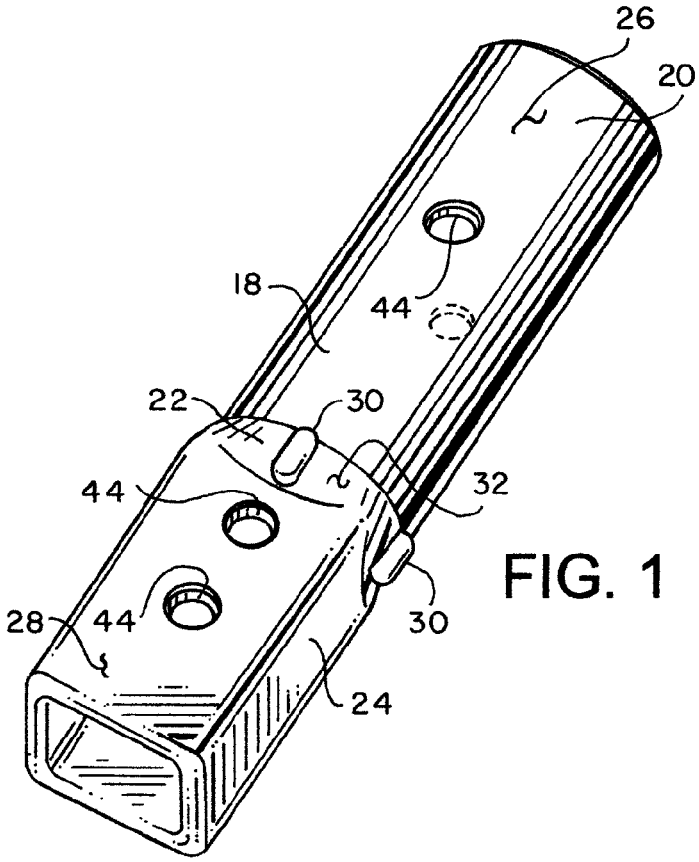
FIG. 1 is a perspective view of the coupler used in the delineator mounting system of the present invention.
Figure 3:
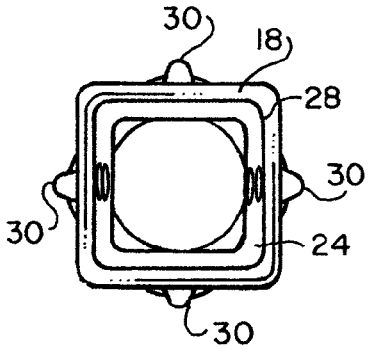
FIG. 3 is a bottom end view thereof.
Figure 2:
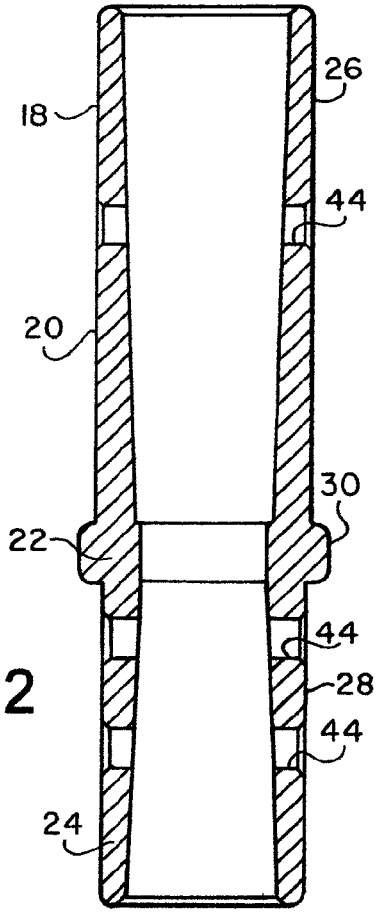
FIG. 2 is a partially broken away side view thereof.
Figure 4:
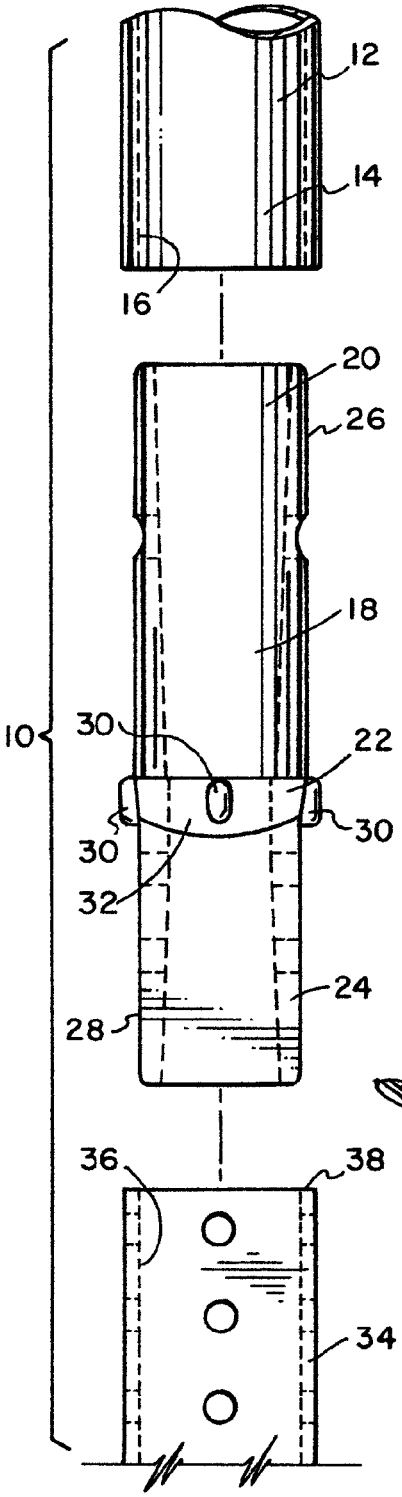
FIG. 4 is an exploded side view of the delineator mounting system.

Referring to FIGS. 1-6, where like numerals refer to like and corresponding parts, delineator mounting system 10 includes a delineator 12 with a lower end 14 having a cylindrical inner surface 16.

A coupler 18 has an upper end 20, a transition portion 22, and a lower end 24. The coupler upper end 20 has a cylindrical outer surface 26 sized to closely interfit within the delineator lower end inner surface 16. The coupler lower end 24 has a square cross-section outer surface 28. The coupler transition portion 22 is in a medial location of the coupler 18 between the upper and lower ends 20,24. The coupler transition portion 22 includes a plurality of abutment projections 30 extending from an outer surface 32 thereof.

Figure 5:
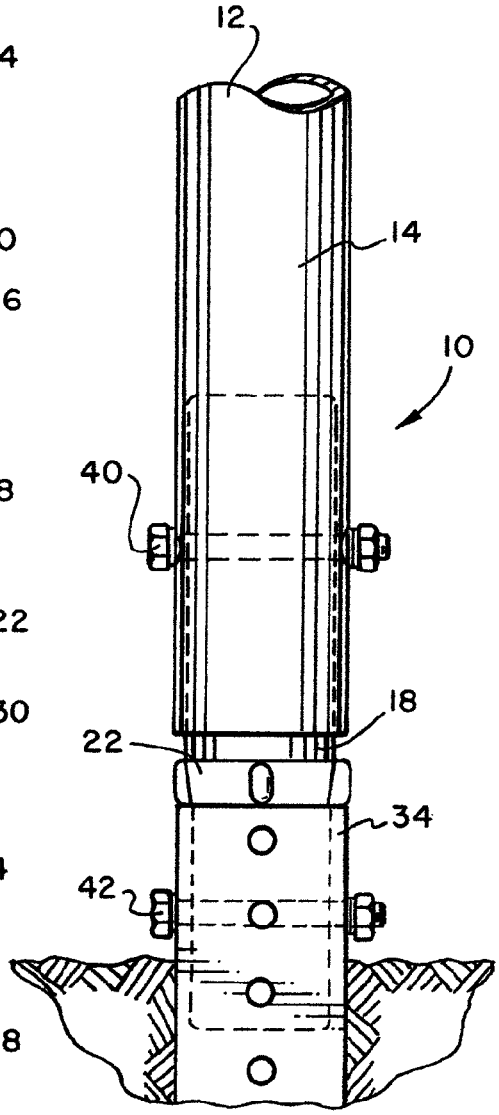
FIG. 5 is an enlarged side elevational view of the assembled delineator mounting system.
Figure 6:
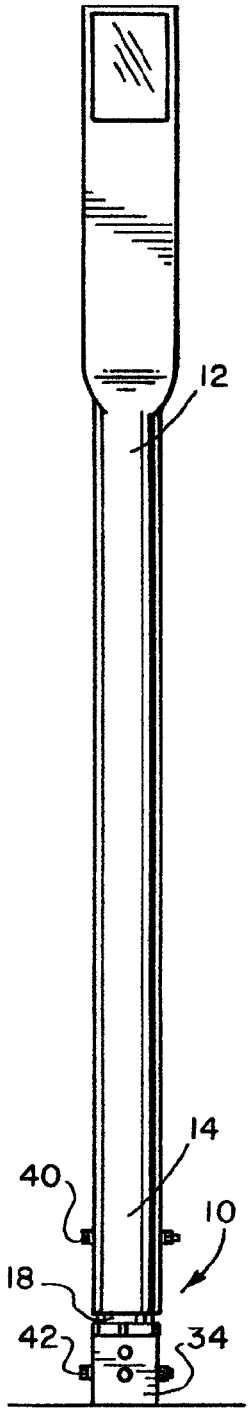
FIG. 6 is a side elevational view of the assembled delineator mounting system.

A mount 34 is adapted to be driven into the earth as shown in FIGS. 5 and 6. The mount 34 has a square cross-section inner surface 36 sized to closely interfit about the coupler lower end outer surface 28.

In operation, the delineator lower end 14 is interfitted with the coupler upper end 20, the coupler lower end 24 is interfitted with the mount 34, and the abutment projections 30 contact an upper edge 38 of the mount 34.

The system 10 is completed when an upper fastener 40 extends through the coupler upper end 20 and delineator lower end 14, and a lower fastener 42 extends through the coupler lower end 24 and the mount 34. The coupler has through holes 44 to accommodate the fasteners 40,42 at appropriate locations.

It will be understood that each of the elements described above, or two or more together, may also find a useful application in other types of constructions differing from the type described above.

While the invention has been illustrated and described as embodied in a particular delineator mounting system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A delineator mounting system, comprising;

a delineator lower end having a cylindrical inner surface;

a coupler having an upper end, a transition portion, and a lower end;

the coupler upper end having a cylindrical outer surface sized to closely interfit within the delineator lower end inner surface;

the coupler lower end having a square cross-section outer surface;

the coupler transition portion in a medial location of the coupler between the upper and lower ends;

a mount adapted to be driven into the earth, the mount having a square cross-section inner surface sized to closely interfit about the coupler lower end outer surface;

the delineator lower end interfitted with the coupler upper end, the coupler lower end interfitted with the mount; and with the coupler transition portion including a plurality of abutment projections extending from an outer surface thereof, and the abutment projections contacting an upper edge of the mount.

2. A delineator mounting system, comprising;

a delineator lower end having a cylindrical inner surface;

a coupler having an upper end, a transition portion, and a lower end;

the coupler upper end having a cylindrical outer surface sized to closely interfit within the delineator lower end inner surface;

the coupler lower end having a square cross-section outer surface;

the coupler transition portion in a medial location of the coupler between the upper and lower ends;

the coupler transition portion including a plurality of abutment projections extending from an outer surface thereof;

a mount adapted to be driven into the earth, the mount having a square cross-section inner surface sized to closely interfit about the coupler lower end outer surface;

the delineator lower end interfitted with the coupler upper end, the coupler lower end interfitted with the mount, the abutment projections contacting an upper edge of the mount;

an upper fastener extending through the coupler upper end and delineator lower end; and a lower fastener extending through the coupler lower end and the mount.

* * * * *